United States Patent [19]

Watanabe et al.

[11] Patent Number: 4,547,639

[45] Date of Patent: Oct. 15, 1985

[54] VACUUM CIRCUIT BREAKER

[75] Inventors: Ryuji Watanabe, Ibaraki; Kiyoji Iwashita, Hitachi; Sadami Tomita, Katsuta; Keiichi Kuniya; Hideaki Tsuda, both of Hitachi, all of Japan

[73] Assignee: Hitachi, Ltd., Tokyo, Japan

[21] Appl. No.: 274,679

[22] Filed: Jun. 17, 1981

[30] Foreign Application Priority Data

Jun. 18, 1980 [JP] Japan ..... 55-81425

[51] Int. Cl.[4] ..... B22F 3/00; H01H 33/66

[52] U.S. Cl. ..... 200/144 B; 419/6; 428/567; 200/279

[58] Field of Search ..... 200/265, 144 B, 279, 200/144 A; 428/567; 419/6

[56] References Cited

U.S. PATENT DOCUMENTS 2,247,754 7/1941 Hensel et al. ..... 428/567

3,379,846 4/1968 Wood et al. ..... 200/144 B 3,957,453 5/1976 Hässler et al. ..... 75/245

3,980,850 9/1976 Kimblin ..... 200/279

4,014,659 3/1977 Hässler et al. ..... 428/567

4,267,416 5/1981 Paulus ..... 200/144 B

*Primary Examiner*—Edward A. Miller

*Assistant Examiner*—Anne Brookes

*Attorney, Agent, or Firm*—Antonelli, Terry & Wands

[57] ABSTRACT

A vacuum circuit breaker comprising a vacuum vessel and a pair of electrodes disposed in the vessel, which is superior in chopping current characteristic, at least a contact of at least one of the electrodes being made of a member having a skeleton of an iron group element, pores in which skeleton are impregnated with at least one kind selected from a group consisting of silver; an alloy of Ag and at least one of Te, Se, Bi, Pb, Tl, In, Cd, Sn and Sb; and the intermetallic compound of Ag, the breaker having rated voltage of 3.6 to 36 KV and rated breaking currents of 8 to 60 KA.

23 Claims, 4 Drawing Figures

VACUUM CIRCUIT BREAKER

BACKGROUND OF THE INVENTION

This invention relates to a vacuum circuit breaker, and more particularly to one working at rated voltage of 3.6 to 36 KV and rated breaking current of 8 to 60 KA.

There is a chopping phenomenon, which is a phenomenon particular to the vacuum circuit breaker. The phenomenon is one in which a current chops suddenly before it comes down naturally to a zero point at the time of breaking a circuit or, particularly, a small current. The current at the time of such chopping occurring is called the chopping current. An occurrence of chopping may lead to an abnormally high surge voltage on equipment at the load side such as a rotary machine and transformer, with the result that dielectric breakdown is apt to occur. The larger the value of the chopping current, the more that dielectric breakdown becomes apt to occur.

On the other hand, in a vacuum circuit breaker there flows not only a rated current but occasionally there also flows a short-circuit current that is far larger than the rated current. Even in such case, it is necessary for the vacuum circuit breaker to operate normally so as to break the short-circuit current. It is therefore desirable that the vacuum circuit breaker has the characteristic of small chopping current for making the surge voltage small and a breaking a large current. The matter that the breaker is capable of breaking large currents is hereinafter referred to as "breaking performance". The better the breaking performance is, i.e., the larger the current value capable of being broken is, the more the vacuum circuit breaker becomes capable of effecting the breaking in a case of a short-circuit accident, thus the safety of the vacuum circuit breaker being improved.

To improve the chopping current and breaking performances, there have been hitherto effected many attempts mainly to improve the material of the electrodes. For example, in U.S. Pat. No. 3,014,110, U.S. Pat. No. 3,683,138 and U.S. Pat. No. 3,993,481 specifications, there are shown examples in which electrode materials are improved in view of chopping current. In the specification of U.S. Pat. No. 3,683,138 there is shown a contact made of a sintered alloy of Ag and WC; the specification of U.S. Pat. No. 3,993,481 discloses a contact made of another alloy in which there are dispersed T, Bi, Pb and etc. in a matrix of an eutectic alloy including Co and other elements. Generally, however, the situation is such that the vacuum circuit breaker with small chopping current characteristic is inferior in breaking performance, while in other vacuum circuit breakers with superior breaking performance, the chopping current becomes large in value.

SUMMARY OF THE INVENTION

The object of the invention is to provide a vacuum circuit breaker which is remarkably superior in breaking performance while having a relatively low chopping current characteristic, in comparison with a conventional vacuum circuit breaker having contacts made of a sintered alloy of Ag and WC.

Specifically, the object of the invention is to provide a vacuum circuit breaker working at rated voltages of 3.6 to 36 KV and at a rated breaking current of 8 to 60 KA, which is remarkably superior in breaking performance while having a chopping current characteristic somewhat larger but not very high in value in comparison with a conventional vacuum circuit breaker having contacts made of sintered alloy of a Ag and WC.

The present invention provides a vacuum circuit breaker having a vacuum vessel and a pair of electrodes placed in the vessel, wherein a contact of at least one of said electrodes is constituted by a member having a skeleton impregnated with at least one material selected from the group consisting of Ag; an alloy of Ag and at least one of Te, Se, Bi, Pb, Tl, In, Cd, Sn and Sb; and and intermetallic compound of Ag.

The electrode for the vacuum circuit breaker is normally a plate shaped electrode having a thickness of from several millimeters to ten-odd millimeters, and the whole plate is made of the same component material entirely. The member having a skeleton of and iron group element, which skeleton has pores impregnated with at least one material selected from a group consisting of silver, silver alloys and intermetallic compounds of silver, is applicable satisfactorily to such an electrode of an integral structure type, and the member can also be used only for the contact.

In a case where the member is used only for the contact, it is preferable that other parts be constituted by a material of greater conductivity than the contact member such as, for example, pure copper or pure silver. Such constitution will be effective to make electric resistance smaller than in the case where the electrode is formed integrally only by the member, so that the conductivity capacity of the contact becomes large. To adopt the member only for the contact, such method will be available as brazing, screwing or inserting the member into a recess slightly smaller than the dimension of the member, which recess has been previously formed in the conductive part. Of course, there may be used methods other than the above-described method for forming a composite electrode. That is, such composite electrode may be formed by joining the member and the conductive part at the time of the production of the member, or other means such as welding and hot pressure bonding, etc., may be employed to produce such composite electrode.

The inventors have discovered that the vacuum circuit breaker having an electrode of and iron group element is remarkably superior in breaking performance to that of a conventional one having a WC electrode and has a low chopping current characteristic. However, there was such problem that the chopping current of such electrode is still too high to use it as an electrode for a vacuum circuit breaker of low surge.

To remove the problem, silver is selected as an element for reducing the value of chopping current, which element is insoluble in iron group elements, and silver is mixed with an iron group element, whereby the chopping current can be lowered without deteriorating the breaking performance, that is, it becomes possible to use this material for obtaining a vacuum circuit breaker of low surge type. To further reduce the value of chopping current, there is added in the material an element having a low melting point and high vapor pressure, so that it was found that, if this element exists in the form of a silver alloy and/or intermetallic compound which alloy or compound is not soluble in the iron group element, the chopping current can be minimized without substantial deterioration of the breaking performance. Such element is selected from the group consisting of Te, Se, Bi, Pb, Tl, In, Cd, Sn and Sb.

It is necessary that the iron group element is not soluble substantially in other elements and exists alone independently. If it exists in the form of and alloy with other elements, a large deterioration will result regarding breaking performance, while the material will become very brittle regarding mechanical properties.

In a case where the member having the skeleton of and iron group element, the pores of which skeleton are impregnated with at least one material selected from the group consisting of Ag; an alloy of Ag and at least one of Te, Se, Bi, Pb, Tl, In, Cd, Sn and Sb; and and intermetallic compound of Ag, is used only for a contact, it is preferred to shape this member into a ring configuration and to provide an arc driving groove on the other part. Such constitution may further minimize the chopping current and also increase the breaking performance.

The invention will be described more particularly in this respect. By providing a ring-shaped projecting part on the surface of a plate-shaped electrode, the projecting part works as a contact at which an arc is generated. By providing then an arc driving groove on the bottom of a recess surrounded by the ring, current flowing between the electrodes moves along a predetermined locus because of the influence of the groove, whereby a magnetic field is produced by the movement of the current along the locus, with the result that the arc rotates circumferentially at a high speed according to an action of the magnetic field. As a result, the arc generated on the ring-shaped contact part is prevented from spreading over the whole surface of the electrode, and the surface of the ring-shaped contact comes to melt locally. Since the part melting through heating is localized as explained above, the arc becomes easy to be cut. A large amount of current can therefore be cut off.

With reference to the chopping phenomenon, on the other hand, there is present metal vapor in the arc, and hence it is preferred that the arc will be prevented from being chopped by the metal vapour.

To provide properties of minimized chopping current and increased breaking performance which appear contradictory to each other, it is conceived that an intensity of the magnetic field the adjusted to such a degree as will not allow the arc to spread over parts other than the ring-shaped portion, thereby making the metallic vapor be emitted only from the ring-shaped portion. Since the member having a skeleton of an iron group element, the pores in which are impregnated with at least one material selected from the group consisting of Ag; an alloy of Ag and at least one of Te, Se, Bi, Pb, Tl, In, Cd, Sn and Sb; and the intermetallic compound of Ag is of a magnetic material, if the ring is formed with this member, a part of the magnetic flux comes to pass the interior surrounded by the ring. Thus, the magnetic field working to rotate the arc is weakened, so that rotation of the arc is faded, whereby the metallic vapor becomes hard to be interrupted. Thus the chopping phenomenon becomes hard to occur and the value of the chopping current can be minimized.

Regarding the member constituting a contact part of the electrode, the iron group element means iron, cobalt and nickel. They exist in the form of a simple element metal or and alloy of the iron group elements.

The skeleton of and iron group element is obtained by the steps of mixing raw materials of powder or wire shape and integrating them by use of a binder or by sintering. In this case, it is possible that a part or all of the other material with which the pores of the skeleton are to be impregnated is mixed together with the material of the skeleton. The porosity of the skeleton is desires to be 10 to 90%, the pores in the skeleton being impregnated with one of silver, silver alloys and intermetallic compounds of silver. In a case where the porosity of the skeleton is higher than 10%, deformation is hard to occur when heated by the arc, with the result that the original shape of the member can be retained. Then in a case where the porosity is below 90%, the effect of preventing the chopping which effect is brought about by silver, silver alloys and intermetallic compounds of silver is exerted sufficiently.

The material with which the pores in the skeleton of the iron group element are impregnated exists in the form of at least one of simple substance of silver, alloy of silver, and intermetallic compound of silver.

The material to be filled can be filled by impregnating the pores in the skeleton of the iron group element with fused material. Alternatively, the pores are filled by mixing materials simultaneously at the time of making the skeleton, as described above.

Particularly preferred construction of at least the contact forming member of the electrode is one in which the pores in the skeleton made of a single substance metal of cobalt, iron or nickel or cobalt-iron alloy are impregnated with silver and further impregnated with intermetallic compounds of silver and tellurium and/or selenium.

A vacuum circuit breaker according to the present invention operates effectively in and atmosphere of $10^{-4}$ torr or below and exerts superior chopping current characteristic and breaking performance.

In a vacuum circuit breaker according to the invention, when the vacuum circuit breaker has a maximum chopping current of not more than 3 A and mean chopping current of not more than 1.5 A in measured values in a case where mimic tests are effected in which a current of not more than 10 A is cut in a circuit of 100 V, the breaker of the present invention has a chopping current characteristic equal to that of a breaker shown in the specification of U.S. Pat. No. 3,683,138 and a very superior breaking performance.

The preferred method for producing the member constituting a contact for the electrode comprises the following steps in sequence:

(1) A powdered iron group element or a mixture with powdered silver is filled in a metal mold. Compression compacting is effected as occasion demands. It is preferred to keep the powder surface clean through reduction treatment by heating it at a suitable temperature in hydrogen gas before the compression compacting. A skeleton with preferable porosity is obtained through the compression compacting;

(2) The skeleton is subjected to reduction treatment and then heated in a vacuum to obtain a sintered skeleton, whereby the compact becomes clean and there exists substantially no gas. The point that the skeleton is free from gas is very desirable;

(3) The pores of the skeleton are impregnated with a filling material. A method of putting the skeleton in a molten alloy of the filling material and then applying vacuum to suck up the molten alloy into the pores of the skeleton may be used for such impregnation. Pressurizing the molten alloy with a non-oxidizing gas such as argon simultaneously with applying vacuum will bring about a better result. In a case where the skeleton is impregnated with silver and tellurium and/or selenium instead of silver by itself, these elements are previously alloyed and then the pores of the skeleton are impregnated with the molten alloy of these elements, whereby tellurium, selenium, etc. are prevented from evaporating and being lost at the time of impregnation. It is also preferred to effect the melting of the filling material in a non-oxidizing atmosphere or in a vacuum; and (4) After finishing the impregnation, the member is finished to a predetermined shape through machining. The member is then joined to a conductive member to form a composite as occasion demands.

In the member thus manufactured, the filling or impregnation material can reach the innermost pores in the skeleton of the iron group element. Since there remain substantially no gas in the skeleton pores, the discharge of gas at the time of a breaking operation scarcely occurs. Thus, there is no risk that the filling or impregnation material is pushed out onto the surface of the electrode and low melting point materials such as tellurium and selenium are fused and evaporated by an amount more than necessary one.

EXAMPLE 1

Figure 1:
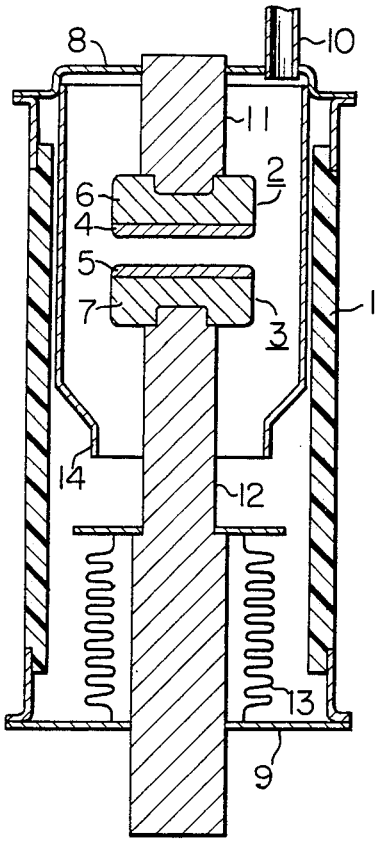
FIG. 1 is a sectional view of a vacuum circuit breaker showing an embodiment of the present invention.

A vacuum circuit breaker according to the invention has suh structure, for example, as illustrated in FIG. 1. Such vacuum circuit breaker has a cylindrical case 1 made of an insulating material such as a ceramic, and a pair of electrodes provided in the case, i.e., a fixed side electrode 2 and a movable side electrode 3. In this example, both electrodes 2 and 3 are of a joined construction. Contacts 4, 5 constituting arc generating portions of the electrodes 2, 3 are made of a material having pores in a skeleton of an iron group element, impregnated with at least one kind of silver, silver alloy and intermetallic compound of silver. A material for the conductive members 6, 7 is, for example, pure copper. The case 1 is hermetically sealed by caps 8, 9 at both its ends so as to remove the influence of the atmospheric air, and an exhaust pipe 10 is provided at one of the caps, which case 1 and caps constitute a vacuum vessel. The interior of the case 1 is exhausted to vacuum by connecting the exhaust pipe 10 to a vacuum pump. The electrodes 2, 3 are fixed on holders 11, 12. A bellows 13 is provided between a part of the holder 12 fixed on the movable side electrode 3 and the cap 9, thereby preventing the from entering through a clearance between the holder 12 and the cap 9, so that airtightness may be maintained. A shield plate 14 is preferably provided in the case 1 such that the plate 14 surrounds a pair of electrodes, whereby the metal constituting the electrode is prevented from being deposited on the inner wall of the case 1 when such metal is evaporated at the time of breaking of current.

Figure 2A:
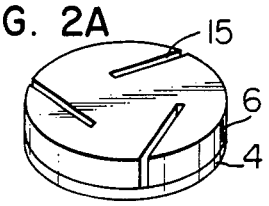
FIGS. 2A and 2B are a perspective views of a vacuum circuit breaker electrode showing another embodiment of the invention.
Figure 2B:
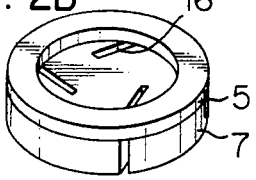

The electrode may have various constructions and shapes. FIGS. 2A and 2B indicate electrodes suitable for minimizing the value of the chopping current at the time of breaking a large current. Such electrodes are of such construction that ring-shaped contacts 4, 5 are integrated with conductive members 6, 7 with arc driving grooves 15, 16 being provided on the surfaces of the conductive members. The electrodes shown in FIG. 2A and 2B comprise a ring-shaped contact made of a composite in which a skeleton of cobalt is impregnated with a molten silver-tellurium alloy, and a conductive member of pure copper. The composite of the ring-shaped contact consists essentially of cobalt of 50% by weight, silver of 45% by weight and tellurium of 5% by weight. Such a contact was produced by the steps of mixing cobalt powder, compacting the powder to prepare a skeleton of ring shape, and impregnating the pores of the skeleton with the molten metal of a silver-tellurium alloy. The contact was then brazed on the conductive member. The silver-tellurium alloy was of such a crystal structure that in a solid state thereof silver-tellurium intermetallic compounds existed in a silver matrix. The intermetallic compound was mainly $Ag_2Te$.

The vacuum circuit breaker having such electrodes and a rated voltage of 7.2 KV and a rated breaking current of 12.5 KA shows the maximum chopping current value of 2 A at the time of breaking small current, and its performance was found satisfactory through actual load tests regarding rotary machines and transformers.

EXAMPLE 2

Integral construction electrodes of 7 kinds were made by a member in which the pores in the skeleton of the iron group element are impregnated with silver, silver and tellurium and/or selenium, and were subjected to tests for inspecting the chopping current value and breaking performance. The electrodes were manufactured as follows:

Co powder was reduced in $H_2$ gas at a temperature of 500° to 550° C., then was pressurized in a mold that was 30 mm in inner diameter and 130 mm in height so as to obtain a predetermined porosity, whereby a skeleton having a predetermined porosity was made. Pressure applied to the skeleton was varied in the range of 0.4 to 8.0 ton/cm$^2$ so as to make the porosity be in a range not more than 60%. The skeleton was then reduced in $H_2$ gas at 900° to 1,000° C. and subjected to a degassing treatment in vacuum at a temperature of 1,000 to 1,100° C.

Next, the skeleton was impregnated in the pores with at least one of silver, silver-tellurium alloy, silver-selenium alloy and silver-tellurium-selenium alloy which were melted in a vacuum. For effecting the impregnation, the skeleton made of cobalt was inserted into the molten alloy retained at a temperature of 950° to 1,000° C. in a vacuumized furnace, argon gas was introduced immediately thereafter, and then the surface of the molten alloy was pressurized at a pressure of 1 to 1.5 atm. After impregnation, a disk-shaped testing electrode having a diameter of 20 mm and a height of 25 mm was obtained through machining.

Figure 3:
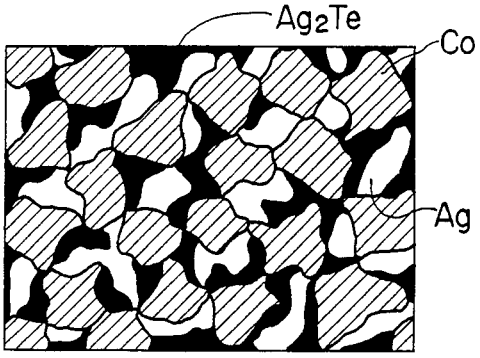
FIG. 3 is a drawing showing the microstructure of a member having a skeleton of cobalt, the pores of which skeleton are impregnated with a silver-tellurium alloy.

A drawing showing the microstructure (about 500 in magnification) of an electrode having a chemical composition consisting essentially of cobalt of 70% by weight, silver of 27% by weight and the balance tellurium is shown in FIG. 3. Large particles hatched by lines are of a cobalt phase. Solidified tellurium exists in the form of and intermetallic compound with silver, that is, mainly as $Ag_2Te$. The slender crystallized grains of black color are of $Ag_2Te$ in FIG. 3. The white color crystallized grains are of the silver. A part of silver remaining without reacting with tellurium exists in the form of a single substance.

The testing electrode was mounted on a holder in a vacuum and gas exhaustable vessel and subjected to baking at 300° C. for degassing. Then, high voltage of 60 KV in maximum value was applied between electrodes, thereby cleaning the surface of the electrodes. Chopping current and breaking performance were measured. For measurement of the chopping current, the current was regulated so that the maximum value of chopping current may occur when a small current not more than 10 A was broken in a 100 V circuit of about 50 Hz, and then the values of the chopping current at the time of breaking the small current were measured one hundred times to obtain its maximum value and mean value. As regards the breaking performance test, high voltage (6,000 to 7,000 V) was applied at about 50 Hz in frequency, and the breaking of current was effected while increasing the value of breaking current by a step of about 500 to 1,000 A, whereby the threshold value of the breaking current was obtained.

Chemical compositions of the electrode materials and test results are shown in Table 1. The test results as to silver-tungsten carbide sintered alloy electrodes and copper-lead-bismuth alloy electrodes described in U.S. Pat. No. 3,683,138 are also shown therein for comparison.

Values of the breaking performance are shown as the ratio of the measured breaking current value to the threshold value of breaking current of a sintered alloy electrode of silver and tungsten carbide of 70% by weight when such threshold value is made 100%.

TABLE 1

| No. | Material of Electrode (weight percent) | Chopping Current (A) Max. Value | Chopping Current (A) Mean Value | Breaking Performance (%) |
|---|---|---|---|---|
| The present invention | | | | |
| 1 | Co—50Ag | 3.9 | 2.5 | 250 |
| 2 | Co—80Ag | 3.8 | 2.3 | 200 |
| 3 | Co—10Ag—10Te | 2.30 | 1.25 | 150 |
| 4 | Co—30Ag—10Te | 1.80 | 0.85 | 195 |
| 5 | Co—50Ag—10Te | 1.90 | 0.90 | 170 |
| 6 | Co—50Ag—10Se | 1.80 | 0.85 | 170 |
| 7 | Co—50Ag—5Te—5Se | 1.7 | 0.7 | 165 |
| Prior Art for Comparison | | | | |
| I | Ag—40WC | 2.6 | 1.5 | 90 |
| II | Ag—70WC | 2.3 | 1.0 | 100 |
| III | Cu—10BiPb | 2.50 | 1.40 | 120 |

EXAMPLE 3

Testing electrodes in an integrated structure were made by use of members having compositions shown in Table 2.

Since it seemed that in the case of these electrodes the skeleton of cobalt could hardly be impregnated at one time with all of the silver due to the very large amount of the silver, a part of the silver was previously mixed with cobalt powder, and the skeleton was made by use of the mixed powder so that a part of the silver may be included in the skeleton. After the skeleton was made, it was impregnated with silver-tellurium alloy and machined to a predetermined shape of the testing electrode through the same steps as in the case of Example 2. Results obtained through measuring the chopping current and breaking performance of these electrodes under the same conditions as in Example 2 are shown in Table 2.

TABLE 2

| No. | Material of Electrode (Weight %) | Chopping Current (A) Max. Value | Chopping Current (A) Min. Value | Breaking Performance (%) |
|---|---|---|---|---|
| 8 | Co—70Ag—10Te | 2.60 | 1.10 | 180 |
| 9 | Co—80Ag—10Te | 3.10 | 1.80 | 165 |

EXAMPLE 4

Electrodes comprising members having compositions shown in Table 3 were made in the same manner as in the case of Example 2. The electrodes were then subjected to tests for inspecting the chopping current and breaking performance under the same conditions as in Example 2. Test results are shown in Table 3. Values representing the breaking performance are shown as the ratio to the breaking performance of the electrode of silver and tungsten carbide of 70% by weight sintered alloy shown in Example 2 when such breaking performance of the electrode in Example 2 is made 100%.

TABLE 3

| No. | Material of Electrode | Chopping Current (A) Max. Value | Chopping Current (A) Mean Value | Breaking Performance (%) |
|---|---|---|---|---|
| 10 | Fe—40Ag | 3.0 | 1.80 | 130 |
| 11 | Fe—50Ag—10Te | 1.3 | 0.60 | 120 |
| 12 | Fe—50Ag—5Te—5Se | 1.4 | 0.70 | 115 |
| 13 | Ni—50Ag—5Te | 1.8 | 0.85 | 125 |
| 14 | Ni—50Ag—5Se | 1.6 | 0.80 | 115 |
| 15 | Fe—25Co—50Ag | 2.4 | 1.20 | 195 |
| 16 | Fe—25Co—45Ag—5Te | 1.8 | 0.85 | 170 |
| 17 | Fe—35Co—45Ag—5Te | 1.7 | 0.80 | 155 |
| 18 | Co—45Ag—5Pb | 1.9 | 0.95 | 145 |
| 19 | Co—45Ag—5Bi | 1.9 | 0.90 | 140 |
| 20 | Co—45Ag—5Cd | 2.3 | 1.25 | 135 |
| 21 | Co—45Ag—5In | 2.4 | 1.30 | 130 |
| 22 | Co—45Ag—5Tl | 2.1 | 1.00 | 130 |
| 23 | Co—45Ag—5Sb | 2.4 | 1.50 | 130 |
| 24 | Co—45Ag—5Sn | 2.7 | 1.40 | 135 |
| 25 | Ni—40Ag | 1.8 | 0.90 | 165 |

We claim:

1. A vacuum circuit breaker comprising a vacuum vessel and a pair of electrodes disposed in the vessel and provided with contacts, at least a contact of at least one of said electrodes comprising a member having a skeleton of at least one iron group element selected from the group consisting of Fe, Ni and Co, pores of said skeleton being impregnated with at least one material selected from the group consisting of an alloy of Ag and at least one of Te, Se, Bi, Pb, Tl, In, Cd, Sn and Sb; and an intermetallic compound of Ag and at least one of Te, Se, Bi, Pb, Tl, In, Cd, Sn and Sb, the member, having a skeleton of said at least one iron group element the pores of which are impregnated with said at least one material selected from said alloy of Ag and said intermetallic compound of Ag, reducing the value of the chopping current while, at the same time, improving the breaking performance.

2. A vacuum circuit breaker according to claim 1, wherein a porosity of said skeleton is 10 to 90%.

3. A vacuum circuit breaker according to claim 1, wherein said intermetallic compound is of silver and tellurium and/or selenium.

4. A vacuum circuit breaker according to claim 1, wherein said skeleton of an iron group element is of cobalt, the pores in the skeleton being impregnated with silver and the intermetallic compound of silver and tellurium and/or selenium.

5. A vacuum circuit breaker according to claim 1, wherein said skeleton of an iron group element is of an cobalt-iron alloy, the pores in the skeleton being impregnated with silver and the intermetallic compound of silver and tellurium and/or selenium.

6. A vacuum circuit breaker according to claim 1, wherein said skeleton of an iron group element is of nickel, and the pores in the skeleton are impregnated with silver and the intermetallic compound of silver and tellurium and/or selenium.

7. A vacuum circuit breaker according to claim 1, wherein said skeleton of iron group element is of iron, and the pores in the skeleton is impregnated with silver and the intermetallic compound of silver and tellurium and/or selenium.

8. A vacuum circuit breaker according to claim 1, wherein said skeleton of an iron group element is made by mixing a raw material of powder and compacting it.

9. A vacuum circuit breaker according to claim 1, wherein at least the contact of said electrodes is made of a member manufactured through the following steps of:

(1) mixing a powdery or wire-shaped raw material of said iron group element and compacting it to a predetermined skeleton shape;

(2) effecting reduction treatment with respect to said skeleton and then effecting heat treatment in vacuum;

(3) melting said at least one material selected from the group consisting of an alloy of Ag and at least one of Te, Se, Bi, Pb, Tl, In, Cd, Sn and Sb; and an intermetallic compound of Ag and at least one of Te, Se, Bi, Pb, Tl, In, Cd, Sn and Sb; and then impregnating it in the skeleton by use of vacuum while adding pressure onto the surface of said molten alloy by use of a non-oxidizing gas; and (4) machining the impregnated member to a predetermined shape after it is solidified.

10. A vacuum circuit breaker according to claim 1, wherein said member consists essentially of said skeleton with the pores thereof being impregnated with said at least one material.

11. A vacuum circuit breaker according to claim 1, wherein said member consists of said skeleton with the pores thereof being impregnated with said at least one material.

12. A vacuum circuit breaker according to claim 1, wherein the at least one material contains at least 9% by weight of said at least one of Te, Se, Bi, Pb, Tl, In, Cd, Sn and Sb.

13. A vacuum circuit breaker comprising a vacuum vessel and a pair of electrodes arranged in the vessel, wherein at least one of said electrodes has such a construction that a contact, made of a member having a skeleton of an iron group element, pores in said skeleton being impregnated with at least one material selected from the group consisting of an alloy of Ag and at least one of Te, Se, Bi, Pb, Tl, In, Cd, Sn and Sb; and an intermetallic compound of Ag and at least one of Te, Se, Bi, Pb, Tl, In, Cd, Sn and Sb, is electrically conductively adhered to a conductive member, the member, having a skeleton of an iron group element the pores of which are impregnated with the at least one material selected from the group consisting of said alloy of Ag and said intermetallic compound of Ag, reducing the value of the chopping current while, at the same time, improving the breaking performance.

14. A vacuum circuit breaker according to claim 13, wherein said contact is of a ring-shape, and at least one arc driving groove is provided on a face of said conductive member on which face the contact is joined thereto.

15. A vacuum circuit breaker according to claim 14, wherein said face of said conductive member is in the shape of a solid disc, except for said at least one arc driving groove, and the arc driving groove does not extend therebeyond into said contact.

16. A vacuum circuit breaker according to claim 15, wherein the ring-shaped contact partially overlies said at least one arc driving groove.

17. A vacuum circuit breaker according to claim 13, wherein said member consists essentially of said skeleton with the pores thereof being impregnated with said at least one material.

18. A vacuum circuit breaker according to claim 13, wherein said member consists of said skeleton with the pores thereof being impregnated with said at least one material.

19. A vacuum circuit breaker according to claim 13, wherein the at least one material contains at least 9% by weight of said at least one of Te, Se, Bi, Pb, Tl, In, Cd, Sn and Sb.

20. A vacuum circuit breaker comprising a vacuum vessel and a pair of electrodes arranged in the vessel and provided with contacts, at least a contact of at least one of said electrodes comprising a member having a skeleton of at least one iron group element from the group consisting of Fe, Ni, and Co, pores of said skeleton being impregnated with at least one material selected from the group consisting of an alloy of Ag and at least one of Te, Se, Bi, Pb, Tl, In, Cd, Sn and Sb; and an intermetallic compound of Ag and at least one of Te, Se, Bi, Pb, Tl, In, Cd, Sn and Sb, said breaker having a rated voltage of 3.6 to 36 KV and rated breaking currents of 8 to 60 KA, said breaker having a maximum chopping current value not more than 3 A and mean chopping current value not more than 1.5 A when breaking tests are effected with respect to the circuit of 100 V and current not more than 10 A, the member, having a skeleton of at least one iron group element the pores of which are impregnated with the at least one material selected from the group consisting of said alloy of Ag and said intermetallic compound of Ag, reducing the value of the chopping current while, at the same time, improving the breaking performance.

21. A vacuum circuit breaker according to claim 20, wherein said member consists essentially of said skeleton with the pores thereof being impregnated with said at least one material.

22. A vacuum circuit breaker according to claim 20, wherein said member consists of said skeleton with the pores thereof being impregnated with said at least one material.

23. A vacuum circuit breaker according to claim 20, wherein the at least one material contains at least 9% by weight of said at least one of Te, Se, Bi, Pb, Tl, In, Cd, Sn and Sb.

* * * * *